US008327957B2

(12) United States Patent
Stowe, II et al.

(10) Patent No.: US 8,327,957 B2
(45) Date of Patent: Dec. 11, 2012

(54) DOWNHOLE CUTTING TOOL HAVING CENTER BEVELED MILL BLADE

(75) Inventors: Calvin J. Stowe, II, Bellaire, TX (US); Andrew D. Ponder, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 342 days.

(21) Appl. No.: 12/803,321

(22) Filed: Jun. 24, 2010

(65) Prior Publication Data

US 2011/0315447 A1 Dec. 29, 2011

(51) Int. Cl.
*E21B 10/43* (2006.01)
*E21B 10/62* (2006.01)

(52) U.S. Cl. ..... 175/431

(58) Field of Classification Search ..... 175/431, 175/430, 360, 361
See application file for complete search history.

(56) References Cited

U.S. PATENT DOCUMENTS

| | | | | |
|---|---|---|---|---|
| 4,259,033 | A | 3/1981 | McCreery et al. | |
| 4,357,122 | A | 11/1982 | Hollis, Jr. et al. | |
| 4,577,706 | A * | 3/1986 | Barr | 175/430 |
| 4,593,777 | A | 6/1986 | Barr | |
| 4,717,290 | A | 1/1988 | Reynolds et al. | |
| 4,780,274 | A * | 10/1988 | Barr | 175/433 |
| 4,796,709 | A | 1/1989 | Lynde et al. | |
| 4,934,878 | A | 6/1990 | Plutschuck et al. | |
| 4,978,260 | A | 12/1990 | Lynde et al. | |
| 4,984,488 | A | 1/1991 | Lunde et al. | |
| 5,027,914 | A | 7/1991 | Wilson | |
| 5,058,666 | A | 10/1991 | Lynde et al. | |
| 5,150,755 | A | 9/1992 | Cassel et al. | |
| 5,186,268 | A * | 2/1993 | Clegg | 175/431 |
| 5,244,039 | A * | 9/1993 | Newton et al. | 175/431 |
| 5,297,630 | A | 3/1994 | Lynde et al. | |
| 5,373,900 | A | 12/1994 | Lynde et al. | |

(Continued)

FOREIGN PATENT DOCUMENTS

EP 0234697 A2 9/1987

(Continued)

OTHER PUBLICATIONS

Notification of Transmittal of the International Search Report and the Written Opinion of the International Searching Authority, Or the Declaration, Dec. 7, 2011, pp. 1-2, PCT/US2011/039971, Korean Intellectual Property Office.

(Continued)

*Primary Examiner* — Frederick L Lagman
(74) *Attorney, Agent, or Firm* — Greenberg Traurig LLP; Anthony F. Matheny

(57) ABSTRACT

Downhole cutting tools such as blade mills comprise a body having a first end for connection with a rotating component of a drill string and a cutting end for rotation in unison with the body. The cutting end comprises at least two blades, each of the at least two blades comprising a front sidewall surface, a back sidewall surface, an inner end, an outer end, and at least one beveled portion disposed along the front sidewall surface toward the inner end of each of the at least two blades. At least one of the beveled portions comprise at least one cutting element disposed thereon that is disposed across a center point of the face of the cutting end to provide for cutting away an object disposed in a wellbore to occur across a center point of the cutting end.

20 Claims, 2 Drawing Sheets

U.S. PATENT DOCUMENTS

| | | | | |
|---|---|---|---|---|
| 5,443,565 | A * | 8/1995 | Strange, Jr. | 175/431 |
| 5,456,312 | A | 10/1995 | Lynde et al. | |
| 5,460,233 | A | 10/1995 | Meany et al. | |
| 5,685,671 | A | 11/1997 | Packer et al. | |
| 5,810,079 | A | 9/1998 | Lynde et al. | |
| 5,899,268 | A | 5/1999 | Lynde et al. | |
| 5,979,577 | A * | 11/1999 | Fielder | 175/431 |
| 6,106,585 | A | 8/2000 | Packer et al. | |
| 6,155,343 | A | 12/2000 | Nazzal et al. | |
| 6,167,958 | B1 | 1/2001 | Lynde | |
| 6,308,790 | B1 * | 10/2001 | Mensa-Wilmot et al. | 175/431 |
| 6,422,328 | B1 | 7/2002 | Holland et al. | |
| 6,464,434 | B2 | 10/2002 | Lynde | |
| 6,615,934 | B2 * | 9/2003 | Mensa-Wilmot | 175/431 |
| 7,096,982 | B2 * | 8/2006 | McKay et al. | 175/412 |
| 7,363,992 | B2 | 4/2008 | Stowe et al. | |
| 7,513,319 | B2 | 4/2009 | DeVall | |
| 2003/0034180 | A1 * | 2/2003 | Mensa-Wilmot | 175/431 |
| 2005/0039905 | A1 | 2/2005 | Hart et al. | |
| 2005/0109546 | A1 | 5/2005 | Stowe et al. | |
| 2005/0150656 | A1 | 7/2005 | Stowe | |
| 2005/0269139 | A1 | 12/2005 | Shen et al. | |
| 2006/0090897 | A1 | 5/2006 | Stowe et al. | |
| 2007/0023188 | A1 | 2/2007 | Roberts et al. | |
| 2008/0006446 | A1 | 1/2008 | Stowe et al. | |
| 2008/0149393 | A1 | 6/2008 | McClain et al. | |
| 2008/0296070 | A1 | 12/2008 | Shen et al. | |
| 2008/0302578 | A1 | 12/2008 | Eyre et al. | |
| 2008/0308276 | A1 | 12/2008 | Scott | |
| 2009/0266619 | A1 * | 10/2009 | Durairajan et al. | 175/431 |
| 2010/0012387 | A1 | 1/2010 | Huynh et al. | |
| 2010/0025121 | A1 * | 2/2010 | Schwefe | 175/431 |
| 2010/0108402 | A1 | 5/2010 | Ponder et al. | |
| 2011/0192653 | A1 | 8/2011 | Stowe, II | |
| 2011/0203856 | A1 | 8/2011 | Lynde et al. | |
| 2011/0315448 | A1 | 12/2011 | Stowe, II et al. | |
| 2011/0315455 | A1 | 12/2011 | Stowe, II et al. | |

FOREIGN PATENT DOCUMENTS

| | | |
|---|---|---|
| EP | 0874127 A2 | 10/1998 |

OTHER PUBLICATIONS

International Search Report, Dec. 7, 2011, pp. 1-3, PCT/US2011/039971, Korean Intellectual Property Office.

Written Opinion of the International Searching Authority, Dec. 7, 2011, pp. 1-3, PCT/US2011/039971, Korean Intellectual Property Office.

Notification of Transmittal of the International Search Report and the Written Opinion of the International Searching Authority, Or the Declaration, Dec. 7, 2011, pp. 1-2, PCT/US2011/039962, Korean Intellectual Property Office.

International Search Report, Dec. 7, 2011, pp. 1-5, PCT/US2011/039962, Korean Intellectual Property Office.

Written Opinion of the International Searching Authority, Dec. 7, 2011, pp. 1-3, PCT/US2011/039962, Korean Intellectual Property Office.

Jim McNicol, et al., First true, CT underbalanced casing exit performed, World Oil, Mar. 2005, pp. 25-26, Gulf Publishing Company, USA.

Notification of Transmittal of the International Search Report and the Written Opinion of the International Searching Authority, Or the Declaration, Dec. 7, 2011, pp. 1-2, PCT/US2011/039977, Korean Intellectual Property Office.

International Search Report, Dec. 7, 2011, pp. 1-3, PCT/US2011/039977, Korean Intellectual Property Office.

Written Opinion of the International Searching Authority, Dec. 7, 2011, pp. 1-4, PCT/US2011/039977, Korean Intellectual Property Office.

* cited by examiner

DOWNHOLE CUTTING TOOL HAVING CENTER BEVELED MILL BLADE

BACKGROUND

1. Field of Invention

The invention is directed to downhole cutting tools utilized in oil and gas wells to cut objects within the well and, in particular, to downhole blade mills that are used to cut away, among other objects, stuck tools, bridge plugs, well tubing, well casing, and the like disposed within the well.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool, performing a washover operation with a rotary shoe, or cutting through a tubular with a cutting or milling tool. During the performance of these operations, it is common for the mill blades to be unable to effectively cut of the object being drilled when it is disposed under the center point of the tool because the blades do not extend across the center point of the face of the mill blade(s).

SUMMARY OF INVENTION

Broadly, the invention is directed to downhole cutting tools utilized in cutting away objects disposed within the well. The term "object" encompasses any physical structure that may be disposed within a well, for example, another tool that is stuck within the well, a bridge plug, the well tubing, the well casing, or the like. The downhole cutting tools disclosed herein include blades disposed on a lower face of the tool. The blades are disposed on the lower face such that rotation of the tool causes rotation of the blades. One or more of the blades include a front sidewall surface that has disposed on it one or more cutting elements, also referred to as "cutters," a back sidewall surface, an outer end, an inner end, and at least one beveled portion disposed on the front sidewall surface toward the inner end. The back sidewall surface generally does not include any cutting elements. The presence of the cutting element on the beveled portion allows the blade to be position such that the center point of the face of the downhole cutting tool is covered by a cutting element. In this arrangement, rotation of the downhole cutting tool provides for the portion of the object disposed directly below the center point of the face of the downhole cutting tool to be cut away.

In one particular embodiment, the downhole cutting tool comprises two blades that are disposed opposite one another such that the cutting element disposed on the beveled portions of each of the blades overlap one another. Other embodiments include one or more additional blades disposed on the face of the downhole cutting tool to provide additional cutting power. These one or more additional blades can also include one or more beveled portions containing one or more cutting elements to facilitate cutting the object. For example, all of the blades can be arranged to provide complete cutting across the face of the downhole cutting tool.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Figure 2:
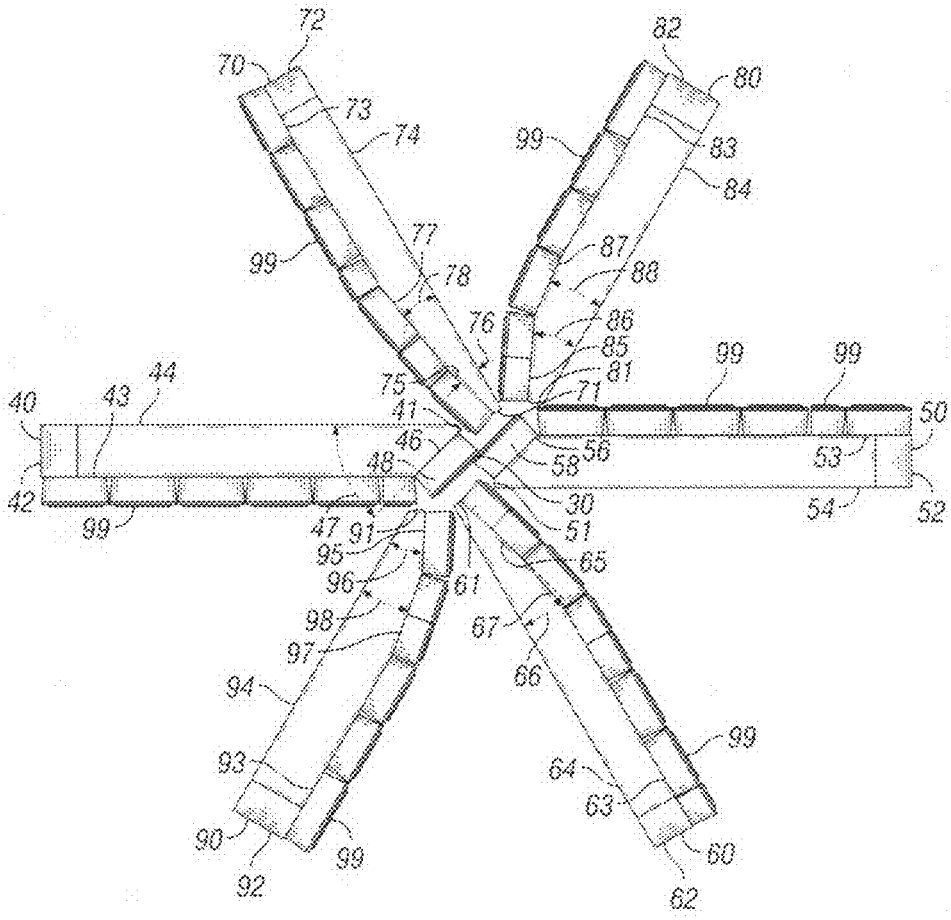
FIG. 2 is a bottom view of the embodiment of the downhole cutting tool of FIG. 1.

Referring now to FIGS. 2-2, downhole cutting tool 10 comprises blade mill 20 having body or housing 22 adapted at upper end 23 to be connected to drill or work string 15, cutting end 24 having face 25, drilling fluid ports 26 through which drilling or cutting fluid flows to facilitate cutting by blade mill 20, and, as shown in the specific embodiment in the Figures, blades 40, 50, 60, 70, 80, 90.

Figure 1:
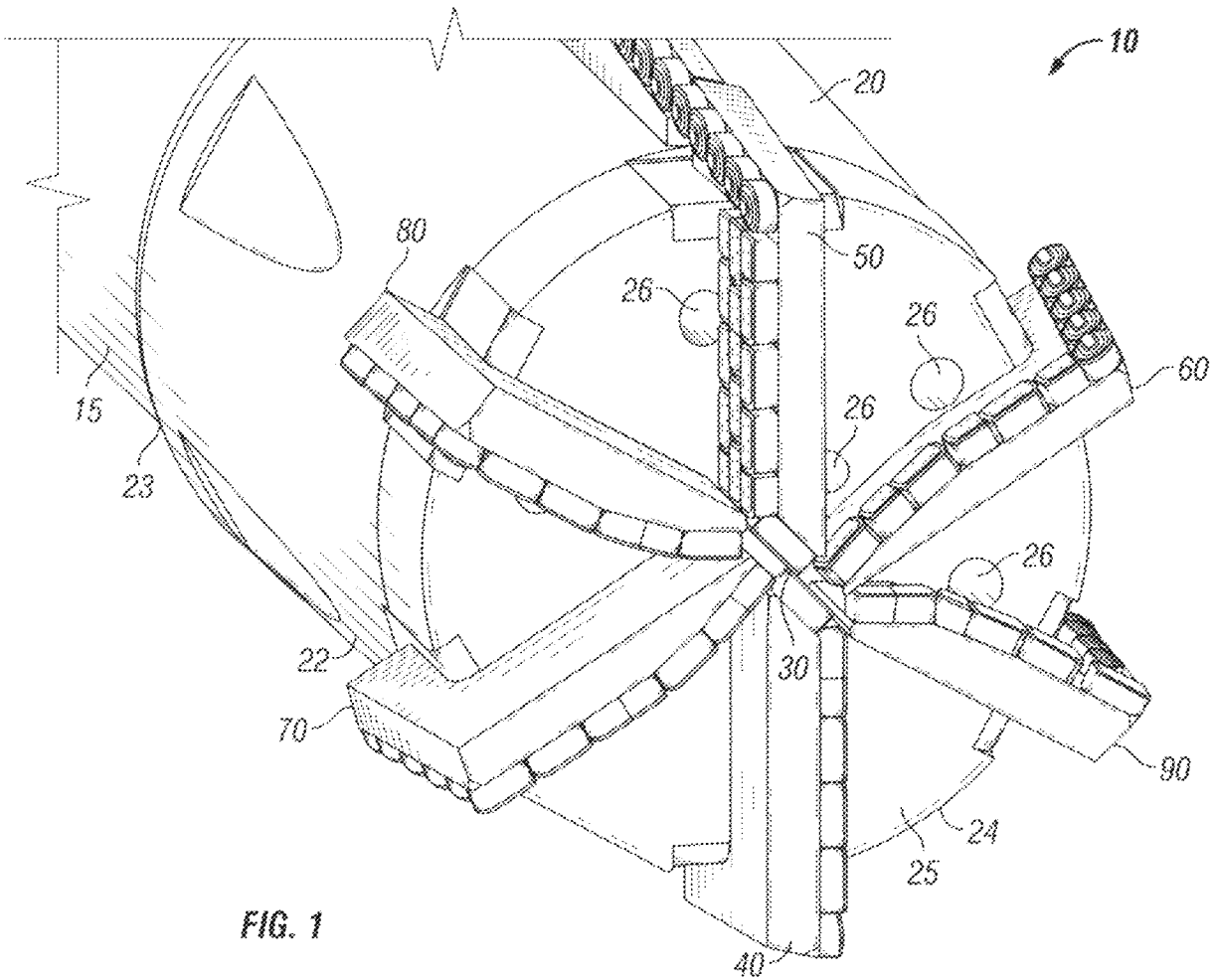
FIG. 1 is a perspective view of one specific embodiment of a downhole cutting tool disclosed herein.

In the embodiment shown in FIGS. 1-2, blade mill 20 includes first blade 40, second blade 50, third blade 60, fourth blade 70, fifth blade 80, and sixth blade 90. As shown, first blade 40 is disposed opposite second blade 50, third blade 60 is disposed opposite fourth blade 70, and fifth blade 80 is disposed opposite sixth blade 90 to form a radial pattern with the inner ends of each of the blades being disposed toward a center point 30 of face 25. As discussed below, first and second blades 40 are shown as being identical to each other, third and fourth blades 60 are shown as being identical to each other, and fifth and sixth blades 70 are shown as being identical to each other. However, it is to be understood that there is no requirement for the blades disposed opposite each other to be identical to each other as shown in the Figures.

First and second blades 40, 50 comprise inner ends 41, 51, outer ends 42, 52, front sidewall surfaces 43, 53, and back sidewall surfaces 44, 54. Disposed along front sidewall surfaces 43, 53, are a plurality of cutting elements 99. In addition, front sidewall surfaces 43, 53 of first and second blades 40, 50 comprise beveled portions 46, 56 disposed toward inner ends 41, 51 of blades 40, 50. Beveled portions 46, 56 include at least one cutting element 48, 58, at least one of which can be disposed across center point 30. As shown in FIGS. 1-2, cutting elements 48, 58 have faces that are disposed toward one another and, in the embodiment shown, overlap and touch one another so that both cutting elements 48, 58 are disposed across center point 30. It is to be understood, however, that the faces of cutting elements 48, 58 do not have to overlap or touch one another. Beveled portions 46, 56 can be disposed at angles relative to the back sidewall surfaces 44, 54 (shown as angle 47 in FIG. 2, but it is to be understood that a similar angle is present on blade 50). Angle 47 and the corresponding angle on blade 50 are in the range from 40 degrees to 50 degrees. In one particular embodiment, angle 47 and the corresponding angle on blade 50 are 45 degrees.

Third and fourth blades 60, 70 comprise inner ends 61, 71, outer ends 62, 72, front sidewall surfaces 63, 73, and back sidewall surfaces 64, 74. Disposed along front sidewall surfaces 63, 73 are a plurality of cutting elements 99. In addition, front sidewall surface 63, 73 of third and fourth blades 60, 70 comprise beveled portion, 65, 75 disposed toward inner ends 61, 71 of blades 60, 70, and beveled portions 67, 77 disposed adjacent beveled portions 65, 75 toward the direction of outer ends 62, 72. Beveled portions 65, 75, 67, 77 can each include at least one cutting element 99. Beveled portions 65, 75 can be disposed at angles 66, 76 relative to back sidewall surfaces 64, 74 that are in the range from 15 degrees to 20 degrees. In one particular embodiment, angles 66, 76 are 17 degrees. Beveled portions 67, 77 can be disposed at angles relative to back sidewall surfaces 64, 74 (shown as angle 78 in FIG. 2, but it is to be understood that a similar angle is present on blade 60). Angle 78 and the corresponding angle on blade 60 are in the range from 7 degrees to 13 degrees. In one particular embodiment, angle 78 and the corresponding angle on blade 60 are 10 degrees.

Fifth and sixth blades 80, 90 comprise inner ends 81, 91, outer ends 82, 92, front sidewall surfaces 83, 93, and back sidewall surfaces 84, 94. Disposed along front sidewall surfaces 83 93 are a plurality of cutting elements 99. In addition, front sidewall surfaces 83, 93 of fifth and sixth blades 80, 90 comprise beveled portions 85, 95 disposed toward inner ends 81, 91 of blades 80, 90, and beveled portions 87, 97 disposed adjacent beveled portions 85, 95 toward the direction of outer ends 82, 92. Beveled portions 85, 95, 87, 97 can include at least one cutting element 99. Beveled portions 85, 95 can be disposed at angles 86, 96 relative to back sidewall surfaces 84, 94 that are in the range from 20 degrees to 30 degrees. In one particular embodiment, angles 86, 96 are 25 degrees. Beveled portions 87, 97 can be disposed at angles 88, 98 relative to back sidewall surfaces 84, 94 that are in the range from 9 degrees to 15 degrees. In one particular embodiment, angles 88, 98 are 12 degrees.

Blades 40, 50, 60, 70, 80, 90 include lengths measured from their respective inner ends to their respective outer ends and widths measured from their respective non-beveled portions of their respective front sidewall surfaces to their respective back sidewall surfaces. In one particular embodiment, the widths of blades 40, 50 are less than the widths of blades 80, 90, and the widths of blades 60, 70 are less than the widths of blades 40, 50. In one particular embodiment, blades 40, 50 each have widths of approximately 0.438 inches, blades 60, 70 each have widths of 0.375 inches, and blades 80, 90 each have widths of approximately 0.5 inches.

It is to be understood that the invention is not limited to the exact details of construction, operation, exact materials, or embodiments shown and described, as modifications and equivalents will be apparent to one skilled in the art. For example, as will be understood by persons skilled in the art, the blade mill may include as few as two blades and as many additional blades as desired or necessary to provide sufficient cutting of the object. Moreover, the angles of the bevel portions of each of the blades can be modified as desired or necessary to facilitate placement of the blades on the face of the cutting end of the blade mill. Further, although not shown in the Figures, cutting elements may be inserted into the spaces between cutting element 48, 58 and cutting element 99 of blades 40, 50 as well as within the space between cutting elements 99 of blades 80, 90. And, the lengths and widths of each of the blades can also be modified as desired or necessary to facilitate placement of the blades on the face of the cutting end of the blade mill. In addition, no blade has to be identical in shape or size to another blade and no blade has to be disposed opposite any other blade. Nor is there any requirement that the downhole cutting tool comprise any set number of blades. And, although the blades are shown in the drawings as being disposed perpendicular to the face, i.e., at an angle of 90 degrees relative to the face, one or more of the blades may be tilted downwardly or upwardly at an angle other than 90 degrees relative to the face. Therefore, it is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. A downhole cutting tool for use in a well, the well having a surface location and a downhole location, the downhole cutting tool comprising:

a body having a first end for connection with a rotating component of a drill string; and a cutting end for rotation in unison with the body, the cutting end comprising at least two blades, each of the at least two blades comprising a front sidewall surface, a back sidewall surface, an inner end, an outer end, and at least one beveled portion disposed along the front sidewall surface toward the inner end of each of the at least two blades, wherein each of the beveled portions comprise at least one cutting element disposed thereon, at least one of the at least one cutting elements being disposed across a center point of the cutting end thereby providing for cutting of an object to occur across the center point of the cutting end when the downhole cutting tool is rotated against an object in the well.

2. The downhole cutting tool of claim 1, wherein the at least one cutting elements disposed on the beveled portions are disposed facing and at least partially overlapping each other.

3. The downhole cutting tool of claim 1, wherein each of the beveled portions is disposed at angles in the range from at least 40 degrees and 50 degrees relative to the back sidewall surfaces.

4. The downhole cutting tool of claim 1, wherein each of the beveled portions is disposed at angles of 45 degrees relative to the back sidewall surfaces.

5. The downhole cutting tool of claim 1, wherein the cutting end further comprises at least two additional blades, each of the two additional blades comprising front sidewall surfaces, back sidewall surfaces, inner ends, outer ends, first beveled portions disposed along the front sidewall surfaces toward the inner ends, and second beveled portions disposed along the front sidewall surfaces adjacent the first beveled portions, wherein each of the first and second beveled portions comprise at least one cutting element disposed thereon.

6. The downhole cutting tool of claim 5, wherein the first beveled portions are disposed at angles in the range from at least 15 degrees to at least 20 degrees relative to the back sidewall surfaces, and the second beveled portions are disposed at angles in the range from at least 7 degrees to at least 13 degrees relative to the back sidewall surfaces.

7. The downhole cutting tool of claim 5, wherein the first beveled portions are disposed at angles of 17 degrees relative to the back sidewall surfaces, and the second beveled portions are disposed at angles of 10 degrees relative to the back sidewall surfaces.

8. The downhole cutting tool of claim 5, wherein the cutting end further comprises at least two more blades, each of the two more blades comprising front sidewall surfaces, back sidewall surfaces, inner ends, outer ends, third beveled portions disposed along the front sidewall surfaces toward the inner ends, and fourth beveled portions disposed along the front sidewall surfaces adjacent the third beveled portions, wherein each of the third and fourth beveled portions comprise at least one cutting element disposed thereon.

9. The downhole cutting tool of claim 8, wherein the third beveled portions are disposed at angles in the range from at least 20 degrees to at least 30 degrees relative to the back sidewall surfaces, and the fourth beveled portions are disposed at angles in the range from at least 8 degrees to at least 15 degrees relative to the back sidewall surfaces.

10. The downhole cutting tool of claim 8, wherein the third beveled portions are disposed at angles of 25 degrees relative to the back sidewall surfaces, and the fourth beveled portions are disposed at angles of 12 degrees relative to the back sidewall surfaces.

11. A blade mill for cutting an object disposed in a wellbore, the blade mill comprising:

an upper end for connecting the blade mill to a work string;

a lower end having a face;

a first blade comprising a first outer end, a first inner end, a first front sidewall surface, and a first back sidewall surface, the first front side wall surface comprising a first beveled portion disposed toward the first inner end, the first beveled portion being disposed at a first angle in the range from at least 40 degrees to at least 50 degrees relative to the first back sidewall surface, the first beveled portion comprising a first cutting element disposed thereon for cutting the object across at least a portion of a center point of the face; and a second blade comprising a second outer end, a second inner end, a second front sidewall surface, and a second back sidewall surface, the second front side wall surface comprising a second beveled portion disposed toward the second inner end, the second beveled portion being disposed at a second angle in the range from at least 40 degrees to at least 50 degrees relative to the second back sidewall surface, the second beveled portion comprising a second cutting element disposed thereon for cutting the object.

12. The blade mill of claim 11, further comprising a third blade comprising a third outer end, a third inner end, a third front sidewall surface, and a third back sidewall surface, the third front side wall surface comprising a third beveled portion disposed toward the third inner end, the third beveled portion being disposed at a third angle in the range from at least 15 degrees to at least 20 degrees relative to the third back sidewall surface, the third beveled portion comprising a third cutting element disposed thereon for cutting the object; and a fourth blade comprising a fourth outer end, a fourth inner end, a fourth front sidewall surface, and a fourth back sidewall surface, the fourth front side wall surface comprising a fourth beveled portion disposed toward the fourth inner end, the fourth beveled portion being disposed at a fourth angle in the range from at least 15 degrees to at least 20 degrees relative to the fourth back sidewall surface, the fourth beveled portion comprising a fourth cutting element disposed thereon for cutting the object.

13. The blade mill of claim 12, further comprising a fifth blade comprising a fifth outer end, a fifth inner end, a fifth front sidewall surface, and a fifth back sidewall surface, the fifth front side wall surface comprising a fifth beveled portion disposed toward the fifth inner end, the fifth beveled portion being disposed at a fifth angle in the range from at least 20 degrees to at least 30 degrees relative to the fifth back sidewall surface, the fifth beveled portion comprising a fifth cutting element disposed thereon for cutting the object; and a sixth blade comprising a sixth outer end, a sixth inner end, a sixth front sidewall surface, and a sixth back sidewall surface, the sixth front side wall surface comprising a sixth beveled portion disposed toward the sixth inner end, the sixth beveled portion being disposed at a sixth angle in the range from at least 20 degrees to at least 30 degrees relative to the sixth back sidewall surface, the sixth beveled portion comprising a sixth cutting element disposed thereon for cutting the object.

14. The blade mill of claim 13, wherein and first blade, second blade, third blade, fourth blade, fifth blade, and sixth blade are all disposed apart from one another in a radial pattern with the inner ends of each of the blades converging toward the center point of the face and the outer ends radiating outward from the center point of the face, the first blade being disposed opposite the second blade, the third blade being disposed opposite the fourth blade, and the fifth blade being disposed opposite the sixth blade, and the first and second cutting elements having cutting element faces that overlap each other across the center point of the face.

15. The blade mill of claim 13, wherein each of the first and second blades comprise a first width, each of the third and fourth blades comprising second width, and each of the fifth and sixth blades comprise a third width, wherein the first width is different from the second and third widths, and the second width is different from the third width.

16. The blade mill of claim 15, wherein the third width is greater than the first and second widths, and the first width is greater than the second width.

17. The blade mill of claim 13, wherein the first and second angles are 45 degrees, the third and fourth angles are 17 degrees, and the fifth and sixth angles are 25 degrees.

18. The blade mill of claim 13, wherein the first blade is disposed opposite the second blade, the third blade is disposed opposite the fourth blade, and the fifth blade is disposed opposite the sixth blade.

19. The blade mill of claim 13, wherein the third blade includes a seventh beveled portion disposed along the third front sidewall surface adjacent the third beveled portion, the seventh beveled portion being disposed at a seventh beveled portion angle in the range from 7 degrees to 13 degrees, the seventh beveled portion comprising a seventh beveled portion cutting element disposed thereon, the fourth blade includes an eighth beveled portion disposed along the fourth front sidewall surface adjacent the fourth beveled portion, the eighth beveled portion being disposed at an eighth beveled portion angle in the range from 7 degrees to 13 degrees, the eighth beveled portion comprising an eighth beveled portion cutting element disposed thereon, the fifth blade includes a ninth beveled portion disposed along the fifth front sidewall surface adjacent the fifth beveled portion, the ninth beveled portion being disposed at a ninth beveled portion angle in the range from 9 degrees to 15 degrees, the ninth beveled portion comprising an ninth beveled portion cutting element disposed thereon, and the sixth blade includes a tenth beveled portion disposed along the sixth front sidewall surface adjacent the sixth beveled portion, the tenth beveled portion being disposed at a tenth beveled portion angle in the range from 9 degrees to 15 degrees, the tenth beveled portion comprising an tenth beveled portion cutting element disposed thereon.

20. A method of cutting an object in a well comprising the steps of:

(a) providing a blade mill, the blade mill comprising an upper end for connecting the blade mill to a work string, a lower end having a face, a first blade comprising a first outer end, a first inner end disposed toward a center point of the face, a first front sidewall surface, and a first back sidewall surface, the first front side wall surface comprising a first beveled portion disposed toward the first inner end, the first beveled portion comprising a first cutting element disposed thereon for cutting the object; and a second blade comprising a second outer end, a second inner end disposed toward the center point of the face, a second front sidewall surface, and a second back sidewall surface, the second front side wall surface comprising a second beveled portion disposed at the second inner end, the second beveled portion comprising a second cutting element disposed thereon for cutting the object;

(b) attaching the upper end of the blade mill to a drill string and lowering the drill string into the well until one or both of the first and second blades contact the object; and (d) rotating the blade mill to cut away the object with the first and second cutting elements.

* * * * *